US009574453B2

(12) United States Patent
Zheng et al.

(10) Patent No.: US 9,574,453 B2
(45) Date of Patent: Feb. 21, 2017

(54) STEAM TURBINE AND METHODS OF ASSEMBLING THE SAME

(71) Applicant: General Electric Company, Schenectady, NY (US)

(72) Inventors: Xiaoqing Zheng, Niskayuna, NY (US); Thomas Joseph Farineau, Schoharie, NY (US); Sacheverel Quentin Eldrid, Saratoga Springs, NY (US); Jason L. Bowers, Rexford, NY (US)

(73) Assignee: General Electric Company, Schenectady, NY (US)

( * ) Notice: Subject to any disclaimer, the term of this patent is extended or adjusted under 35 U.S.C. 154(b) by 537 days.

(21) Appl. No.: 14/146,292

(22) Filed: Jan. 2, 2014

(65) Prior Publication Data

US 2015/0184529 A1 Jul. 2, 2015

(51) Int. Cl.

| | |
|---|---|
| ***F01D 11/02*** | (2006.01) |
| ***F01D 9/04*** | (2006.01) |
| ***F01D 5/08*** | (2006.01) |
| ***F01D 25/12*** | (2006.01) |
| ***F01D 9/06*** | (2006.01) |
| ***F01D 11/00*** | (2006.01) |
| ***F01D 25/24*** | (2006.01) |

(52) U.S. Cl.

CPC ..... *F01D 9/045* (2013.01); *F01D 5/08* (2013.01); *F01D 9/06* (2013.01); *F01D 9/065* (2013.01); *F01D 11/003* (2013.01); *F01D 11/005* (2013.01); *F01D 11/02* (2013.01); *F01D 25/12* (2013.01); *F01D 25/24* (2013.01); *F05D 2240/55* (2013.01); *Y10T 29/49316* (2015.01)

(58) Field of Classification Search

CPC ..... F01D 11/02; F01D 25/12; F01D 5/08; F01D 11/001; F05D 2240/55

See application file for complete search history.

(56) References Cited

U.S. PATENT DOCUMENTS

| | | | |
|---|---|---|---|
| 4,022,872 | A | 5/1977 | Carson et al. |
| 4,055,946 | A | 11/1977 | Sens |
| 4,098,074 | A | 7/1978 | Greenberg et al. |
| 4,112,828 | A | 9/1978 | Mojonnier et al. |
| 4,270,975 | A | 6/1981 | Bennett |
| 4,348,157 | A | 9/1982 | Campbell et al. |
| 4,365,175 | A | 12/1982 | Eckels |
| 4,465,120 | A | 8/1984 | Smith et al. |
| 4,656,975 | A | 4/1987 | Johnson |
| 4,807,667 | A | 2/1989 | Ohnhaus |
| 4,854,126 | A | 8/1989 | Chevis et al. |

(Continued)

*Primary Examiner* — Ninh H Nguyen

(74) *Attorney, Agent, or Firm* — Armstrong Teasdale LLP

(57) ABSTRACT

A steam turbine is provided. The steam turbine includes a housing and a steam inlet configured to discharge a primary steam flow within the housing. A stator is coupled to the housing and a rotor is coupled to the housing and located within the stator. The rotor and the stator are configured to define a primary flow path there between and in flow communication with the primary steam flow. The steam turbine includes a seal assembly coupled to the housing. The seal assembly includes a packing head and a plurality of seals. The packing head is configured to define a cooling flow path in flow communication with the rotor and configured to discharge a cooling steam flow toward the rotor. An anti-swirl device is coupled to the seal assembly and located between the rotor and the packing head.

20 Claims, 8 Drawing Sheets

(56) References Cited

U.S. PATENT DOCUMENTS

| | | | | |
|---|---|---|---|---|
| 4,979,755 | A * | 12/1990 | Lebreton | F16J 15/442 277/303 |
| 5,154,742 | A | 10/1992 | Gault et al. | |
| 5,394,688 | A | 3/1995 | Amos | |
| 5,408,960 | A | 4/1995 | Woytowich | |
| 5,603,510 | A * | 2/1997 | Sanders | F01D 11/025 277/413 |
| 5,669,948 | A | 9/1997 | Brottgardh et al. | |
| 5,746,048 | A | 5/1998 | Shah | |
| 5,769,545 | A | 6/1998 | Bently et al. | |
| 6,435,812 | B1 | 8/2002 | DeStefano et al. | |
| 7,193,123 | B2 | 3/2007 | Stell et al. | |
| 7,553,460 | B2 | 6/2009 | Stell et al. | |
| 7,624,728 | B1 | 12/2009 | Forbes | |
| 7,763,218 | B2 | 7/2010 | Hunter et al. | |
| 7,988,772 | B2 | 8/2011 | Garcia | |
| 8,002,967 | B2 | 8/2011 | Hunter et al. | |
| 8,119,084 | B2 | 2/2012 | Strauss et al. | |
| 8,333,884 | B2 | 12/2012 | Hunter et al. | |
| 8,383,874 | B2 | 2/2013 | Strauss et al. | |
| 8,662,826 | B2 * | 3/2014 | Willett, Jr. | F01D 5/084 415/116 |
| 2009/0208323 | A1 * | 8/2009 | Bowen | F01D 5/081 415/115 |
| 2010/0021283 | A1 * | 1/2010 | Parry | F01D 5/082 415/116 |
| 2010/0166544 | A1 * | 7/2010 | Yamaguchi | F01D 11/001 415/174.5 |

* cited by examiner

STEAM TURBINE AND METHODS OF ASSEMBLING THE SAME

BACKGROUND OF THE INVENTION

The embodiments described herein relate generally to steam turbines, and more particularly, to methods and systems for reducing a swirl effect of a cooling flow for a rotor of the steam turbine.

As steam turbines rely on higher steam temperatures to increase efficiency, steam turbines are fabricated to withstand the higher steam temperatures so as not to compromise the useful life of the turbine. During a typical turbine operation, steam flows from a steam source through a housing inlet and substantially parallel to an axis of rotation along an annular hot steam path. Typically, turbine stages are positioned within the steam path such that the steam flows through vanes and blades of subsequent turbine stages. The turbine blades may be secured to a plurality of turbine wheels, where each turbine wheel is coupled to, or is formed, integral with the rotor shaft for rotation therewith. Alternatively, the turbine blades may be secured to a drum type turbine rotor rather than individual wheels, wherein the drum is formed integrally with the shaft.

At least some turbine blades include an airfoil that extends radially outward from a substantially planar platform, and a root portion that extends radially inwardly from the platform. The root portion may include a dovetail or other means to secure the blade to the turbine wheel of the turbine rotor. In general, during operation, steam flows over and around the turbine blade, which are subject to high thermal stresses. These high thermal stresses may limit the service life of the turbine blades, the wheel, and/or the rotor. More particularly, as steam temperatures increase, the rotor materials may experience creep and rupture. Conventional steam turbines may use materials that are more temperature resistant to increase the operating life and performance of the rotor. However, these materials may increase the cost of fabrication of the turbine rotor. Some steam turbines may inject cooling steam from an intermediate pressure stage towards the rotor. Typical cooling steam, however, may have a swirl effect that may affect the heat transfer from the rotor and/or negatively affect rotor operation.

BRIEF DESCRIPTION OF THE INVENTION

In one aspect, a steam turbine is provided. The steam turbine includes a housing and a steam inlet configured to discharge a first steam flow within the housing. A stator is coupled to the housing and a rotor is coupled to the housing and located within the stator. The rotor and the stator define a first flow path there between in flow communication with the first steam flow. The rotor includes a rotor wheelspace. The steam turbine includes a seal assembly coupled to the housing. The seal assembly includes a packing head and a plurality of seals. The packing head defines a second flow path that is in flow communication with the rotor at a rotor wheelspace and is configured to discharge a second steam flow toward the rotor wheelspace. An anti-swirl device is coupled to the seal assembly and between the rotor wheelspace and the packing head.

In another aspect, a rotor assembly is provided. The rotor assembly is coupled to a housing and located within a primary flow path of a steam turbine. The rotor assembly includes a rotor coupled to the housing. The rotor includes a rotor wheelspace. The rotor assembly further includes a seal assembly coupled to the housing. The seal assembly includes a plurality of seals that define a second flow path that is in flow communication with the rotor wheelspace and discharges a second steam flow toward the rotor wheelspace. An anti-swirl device is coupled to the seal assembly and between the rotor wheelspace and the plurality of seals. The anti-swirl device is configured to reduce a swirl of the cooling steam flow.

In yet another aspect, a method of assembling a steam turbine is provided. The method includes coupling a stator to a housing and coupling a steam inlet in flow communication to the housing. A first flow path is formed within the housing and in flow communication with the steam inlet. The method includes coupling a rotor to the housing and within the stator. The rotor includes a rotor wheelspace and a plurality of blades. A seal assembly is coupled to the housing and includes a plurality of seals that define a second flow path that is in flow communication with the rotor at the rotor wheelspace. The second flow path is configured to discharge a second steam flow toward the rotor wheelspace. The method further includes coupling an anti-swirl device to the seal assembly and between the rotor wheelspace and the plurality of seals.

DETAILED DESCRIPTION OF THE INVENTION

The embodiments described herein relate generally to steam turbines. More particularly, the embodiments relate to methods and systems for use in reducing and/or eliminating a swirl effect of cooling steam flowing within the steam turbine. It should be understood that the embodiments described herein for component cooling are not limited to turbine rotors, and further understood that the description and figures that utilize a steam turbine and rotors are for exemplary purposes only. Moreover, while the embodiments illustrate steam turbines and rotors, the embodiments described herein may be included in other suitable turbine components. Additionally, it should be understood that the embodiments described herein relating to flow paths need not be limited to turbine components. It should also be understood that the terms "primary flow path" and "first flow path" are used interchangeably; the terms "primary steam flow" and "first steam flow" are used interchangeably; the terms "cooling flow path" and "second flow path" are used interchangeably; and, the terms "cooling steam flow" and "second steam flow" are used interchangeably. Specifically, the embodiments may generally be used in any suitable article through which a medium, such as water, steam, air, fuel and/or any other suitable fluid, is directed towards a surface of the article for cooling of the article.

Figure 1:
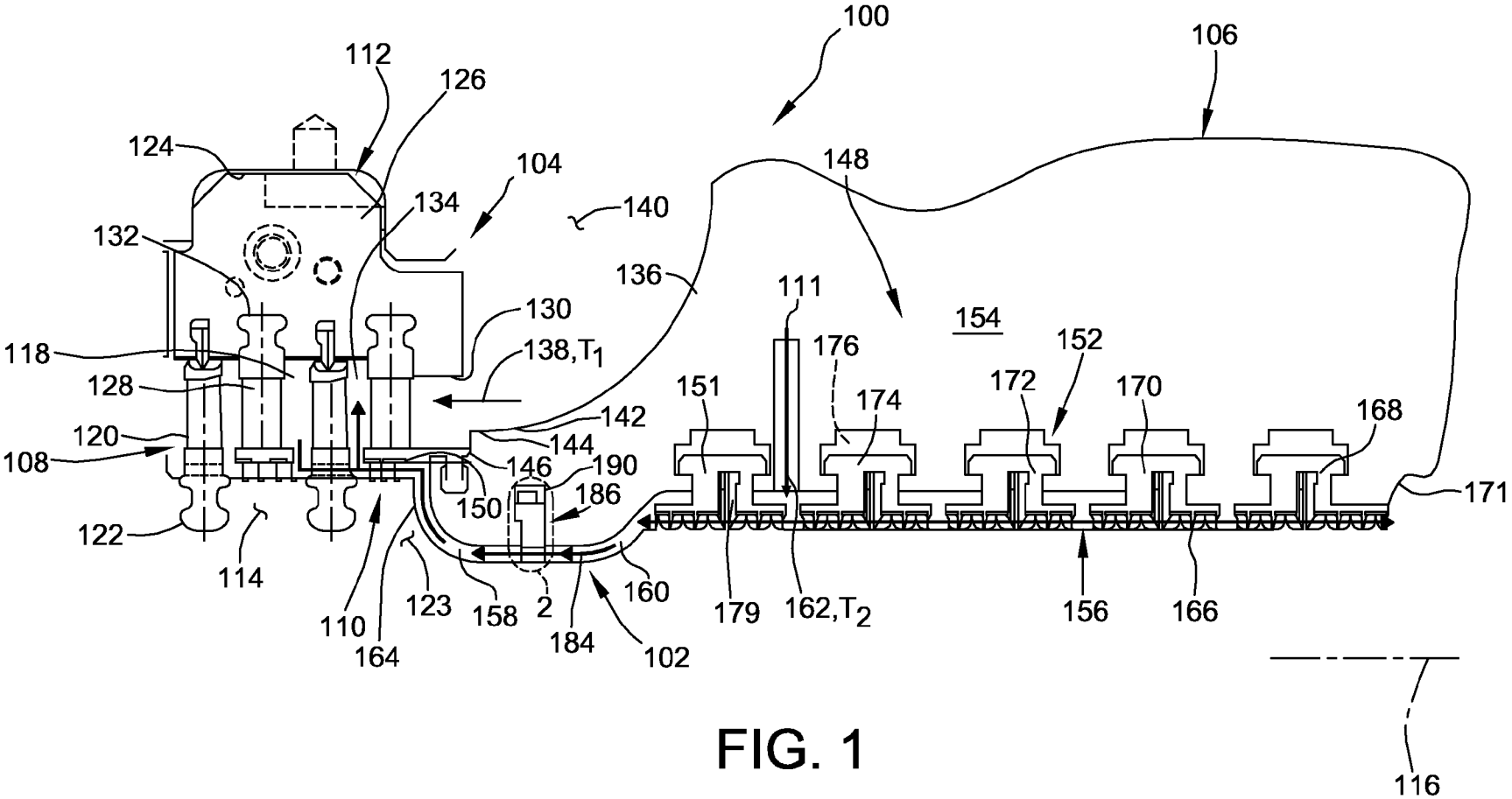
FIG. 1 is a side elevational view of a steam turbine, a rotor assembly and an exemplary anti-swirl device coupled to the steam turbine.
Figure 2:
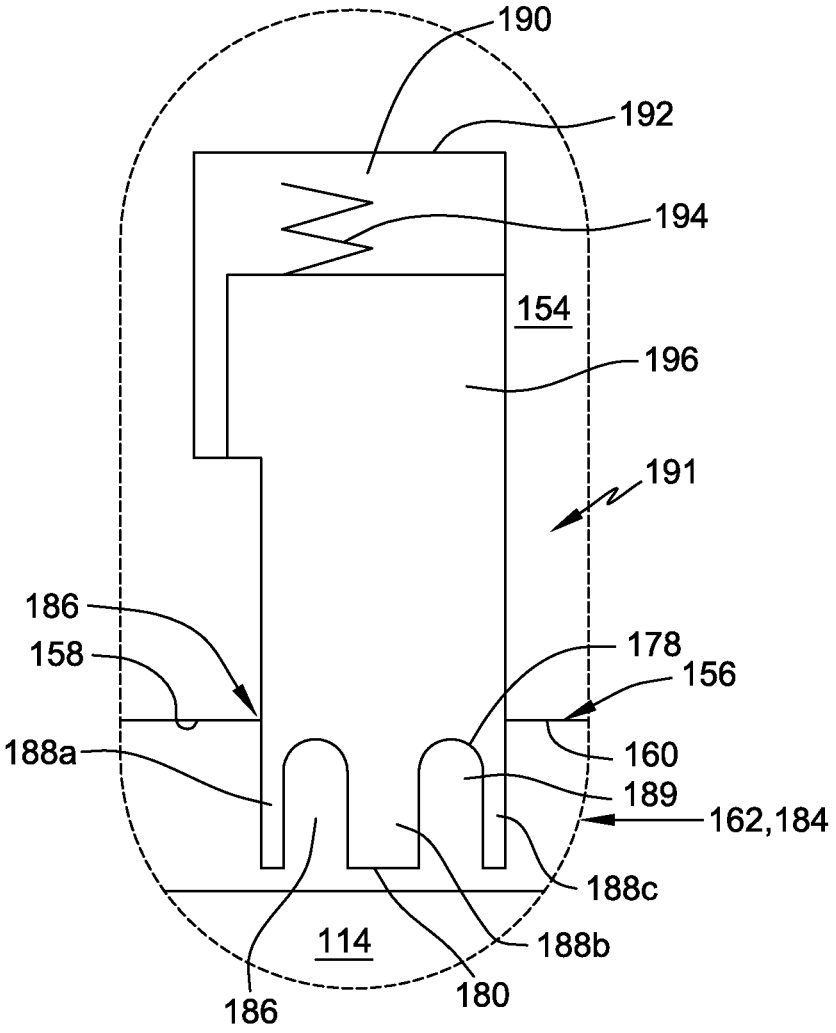
FIG. 2 is a side elevational view of the anti-swirl device shown in FIG. 1 in a first position.
Figure 3:
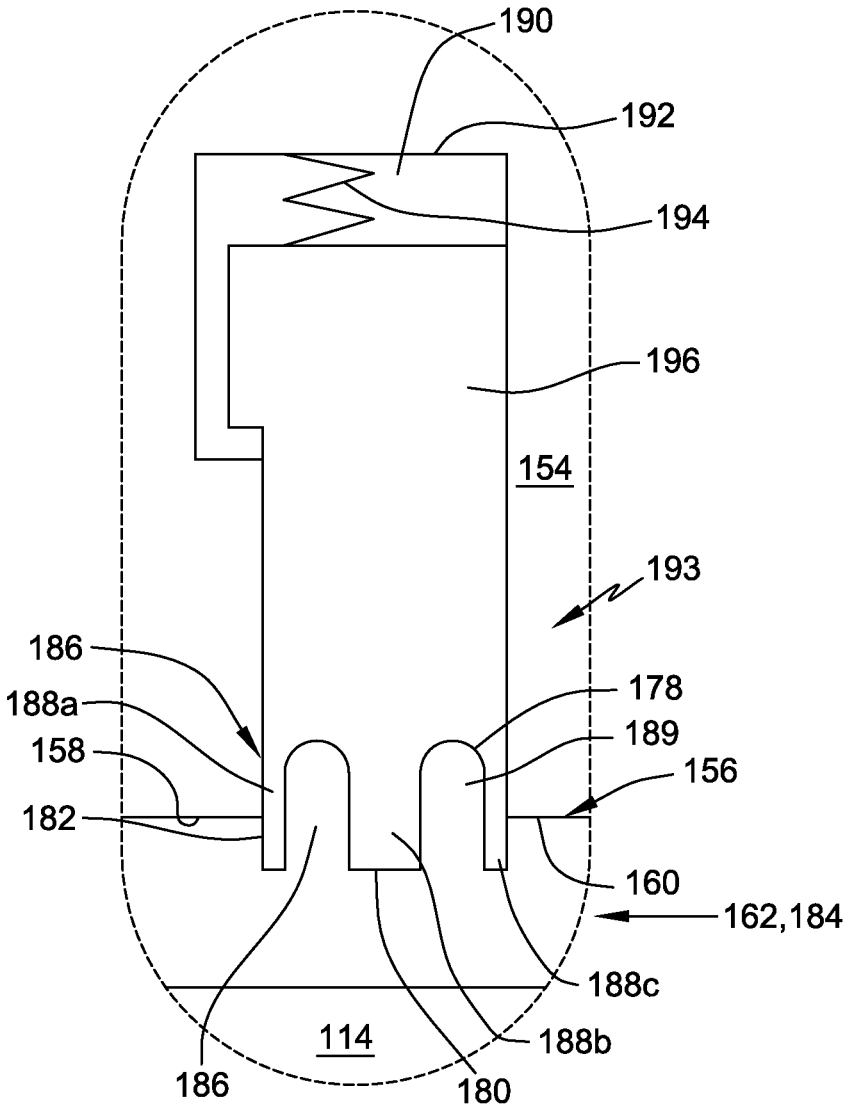
FIG. 3 is a side elevational view of the anti-swirl device shown in FIG. 1 in a second position.
Figure 4:
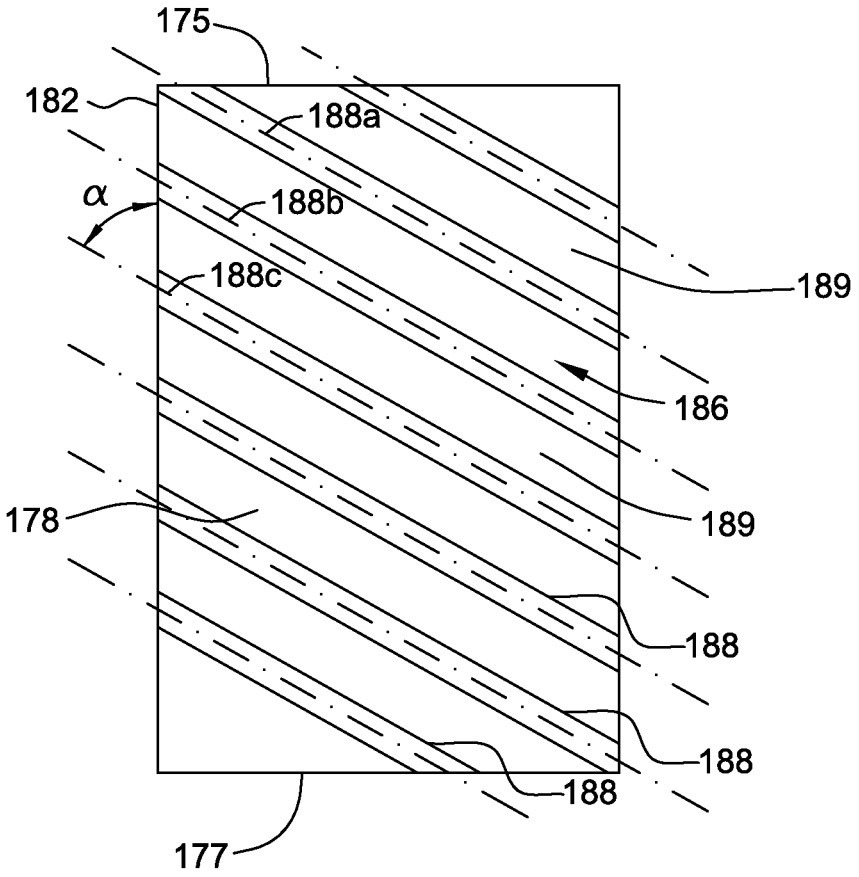
FIG. 4 is a bottom view of the anti-swirl device shown in FIGS. 2 and 3.

FIG. 1 illustrates a side elevational view of a steam turbine 100, a rotor assembly 102, and an anti-swirl device 186 coupled to steam turbine 100. FIG. 2 is a side elevational view of anti-swirl device 186 shown in a first position 191. FIG. 3 is a side elevational view of anti-swirl device 186 shown in a second position 193. FIG. 4 is a bottom view of anti-swirl device 186. In the exemplary embodiment, steam turbine 100 includes a turbine section 104 and a turbine end region 106. Alternatively, steam turbine 100 may include any number of turbine sections, regions, and/or configurations that enable steam turbine 100 to function as described herein. In the exemplary embodiment, turbine section 104 includes a plurality of stages 108 in a spaced relationship with respect to each other. Each stage 108 includes a rotating assembly 110 and a stationary assembly 112. Rotating assembly 110 includes a rotor 114 that rotates about an axis of rotation 116 of steam turbine 100. A plurality of blades 118 are coupled to a plurality of platforms 120, such that each blade 118 extends radially outward from platforms 120 towards stationary assembly 112. A plurality of blade roots 122 are coupled to platforms 120 and extend radially outward from platform 120 and couple to rotor 114. Roots 122 couple blades 118 to a rotor body 123 of rotor 114. Moreover, adjacent blades 118 define a root area 134 located there between. Rotor body 123 includes a rotor wheelspace 164 which experiences high temperatures and high stresses during turbine operation.

Stationary assembly 112 includes a housing 124, a stator 126 and a plurality of stationary vanes 128. Vanes 128 are coupled in dovetails 132 defined in stator 126 and are spaced circumferentially between stages of blades 118. Housing 124 encloses at least one of rotor 114, blades 118, stator 126 and vanes 128. In the exemplary embodiment, rotor 114 and stator 126 are in a spaced relationship that defines a first flow path 130 or primary flow path there between within housing 124. Stationary assembly 112 also includes a steam inlet 136 coupled in flow communication with primary flow path 130. Steam inlet 136 channels a primary steam flow 138 or first steam flow at a first temperature $T_1$ towards primary flow path 130 and in flow communication with the plurality of blades 118. In the exemplary embodiment, steam inlet 136 is located within housing 124 and is in flow communication with a steam source 140 such as, for example, a boiler or heat recovery steam generator. Steam inlet 136 also includes a bowl area 142 having a bowl insert 144 and a leakage flow path 146.

Turbine end region 106 includes a seal assembly 148 coupled to rotor 114. Seal assembly 148 includes a first seal member 150, a second seal member 151 and a third seal member 152. In the exemplary embodiment, seal assembly 148 includes a packing head 154 that is coupled to rotor 114 at an upstream position from steam inlet 136. First seal member 150 reduces leakage of primary steam flow 138 into a rotor wheelspace 164 and facilitates increasing pressure in wheelspace 164 to prevent or limit hot steam ingestion. Rotor wheelspace 164 requires cooling since rotor wheelspace 164 is subjected to high temperatures within the primary flow path 130 and to high stresses experienced by holding rotating blades 118.

Packing head 154 defines a second flow path 156 or cooling flow path having a first section 158 that is in flow communication with primary flow path 130 and a second section 160 that is in flow communication with first section 158. In the exemplary embodiment, a cooling flow source 111 is coupled in flow communication to second flow path 156. Cooling flow source 111 is configured to discharge a second steam flow 162 or cooling steam flow into second flow path 156. In the exemplary embodiment, second steam flow 162 has a second temperature $T_2$ that is different than first temperature $T_1$ of primary steam flow 138. More particularly, second temperature $T_2$ is less than first temperature $T_1$. Alternatively, second temperature $T_2$ may be approximately the same as, or greater than, first temperature $T_1$. Second temperature $T_2$ may have any temperature value that enables cooling of rotor body 123 in rotor wheelspace 164.

Packing head 154 directs and/or discharges second steam flow 162 through second section 160 and first section 158 to facilitate cooling rotor body 123 at rotor wheelspace 164. Third seal member 152 includes one or more seal rings 168, 170, 172 and 174. Seal member 152 is configured to limit cooling flow from leaking out towards a rotor end 171 and/or limit a leaking flow (not shown) from a high-pressure section (not shown) from entering second flow path 156 at rotor end 171.

A plurality of seals 166 are located within flow path 156 to reduce flow leakage of second steam flow 162. Seals 166 may couple to seal rings 168, 170, 172 and 174 and against counterpart portions of rotor 114. Turbine 100 may include any number of seals 166 that enables turbine end region 106 to function as described herein. A spring mechanism 176 biases each seal ring 168, 170, 172, and 174 to a closed position and/or biases each seal ring 168, 170, 172, and 174 to an open position. Seals 166 may include configurations such as, but not limited to, flexible members such as brush seals, honeycomb seals, interlocking and, and/or hydrodynamic face seals. In the exemplary embodiment, second seal member 151 is located between cooling flow source 111 and anti-swirl device 186. In the exemplary embodiment, second seal member 151 includes a brush seal 179. Alternatively, second seal member 151 can include any type of seal to enable turbine end region 106 to function as described herein.

Anti-swirl device 186 is coupled to packing head 154 and is located at least partially within second flow path 156. More particularly, anti-swirl device 186 is located between first section 158 and second section 160. Anti-swirl device 186 includes a first end 178, a second end 180, and a plurality of vanes 188 that are configured to define voids 189 between first end 178 and second end 180. Vanes 188 start from end 178 and terminate at second end 180. Anti-swirl device 186 can be segmented with circumferential end 175 and an opposite end 177. In the exemplary embodiment, vanes 188 also extend between ends 175 and 177. Vanes 188 such as, for example vanes 188*a*, 188*b*, and 188*c*, are angled with respect to side surface 182. More particularly, vanes 188 include an angle $\alpha$ having a range between about 10° and about 90°. More particularly, angle $\alpha$ is about 45°. Alternatively, vanes 188 may include any angle with respect to at least one of circumferential end 175 and circumferential end 177 or can be substantially parallel to axis 116 (shown in FIG. 1).

In the exemplary embodiment, packing head 154 includes a recess 190 that is in flow communication with second section 160. A spring 194 is located between a recess end 192 and anti-swirl device 186. An arm 196 is coupled to spring 194 to move anti-swirl device 186 between first position 191 (FIG. 2) and a second position 193 (FIG. 3) within second section 160. In first position 191, second end 180 is at a close position with respect to rotor 114; and in second position 193, second end 180 is further away from rotor 114. Spring 194 is configured to bias vane 188 into first position 191 to facilitate positioning anti-swirl device 186 in an operation position, while allowing anti-swirl device 186 to move toward second position 193 upon any contact with rotor 114 to facilitate minimum rubbing contact between rotor 114 and anti-swirl device 186 due to rotor vibration and/or misalignment during transient conditions.

Anti-swirl device 186 is located downstream of second seal member 151 and upstream of rotor wheelspace 164 with respect to second steam flow 162. Second steam flow 162 has steam swirl 184 that occurs when second steam flow 162 moves through second flow path 156 and gains a tangential velocity component from rotation of rotor 114. Steam swirl 184 negatively affects heat transfer from rotor wheelspace 164 and/or operation of rotor 114 as second steam flow 162 contacts rotor wheelspace 164. Anti-swirl device 186 reduces and/or eliminates steam swirl 184 present within second steam flow 162. Alternatively, anti-swirl device 186 reverses steam swirl 184 present within second steam flow 162 to increase relative velocity to enhance the heat exchange from rotor 114 and into second steam flow 162 to facilitate cooling rotor wheelspace 164. Heat transfer rate may be correlated to a heat transfer coefficient and a temperature difference. Increasing the relative velocity will increase the heat transfer coefficient and outpace the decrease of temperature difference.

Anti-swirl device 186 reduces and/or eliminates effects of steam swirl 184 present in second steam flow 162 to enhance heat transfer due to the higher relative rotational speed between rotor 114 and second steam flow 162. More particularly, the location of anti-swirl device 186 and the angle $\alpha$ of vane 188 is configured to alter the flow direction of second steam flow 162 to reduce positive steam swirl 184. Alternatively, vane 188 is sized and shaped to reverse steam swirl 184 present in second steam flow 162 by setting the angel $\alpha$ of vane 188 against rotor rotating direction to achieve a negative swirl (not shown). Second steam flow 162 passes anti-swirl device 186 and contacts rotor wheelspace 164 at high relative velocity to facilitate heat transfer from rotor 114 and into second steam flow 162. More particularly, during operation, second steam flow 162 is directed past anti-swirl device 186 and contacts at least one of rotor body 123, roots 122, blades 118, and rotor wheelspace 164 to facilitate heat transfer therefrom. Second steam flow 162 continues to flow and mix with primary steam flow 138.

Figure 5:
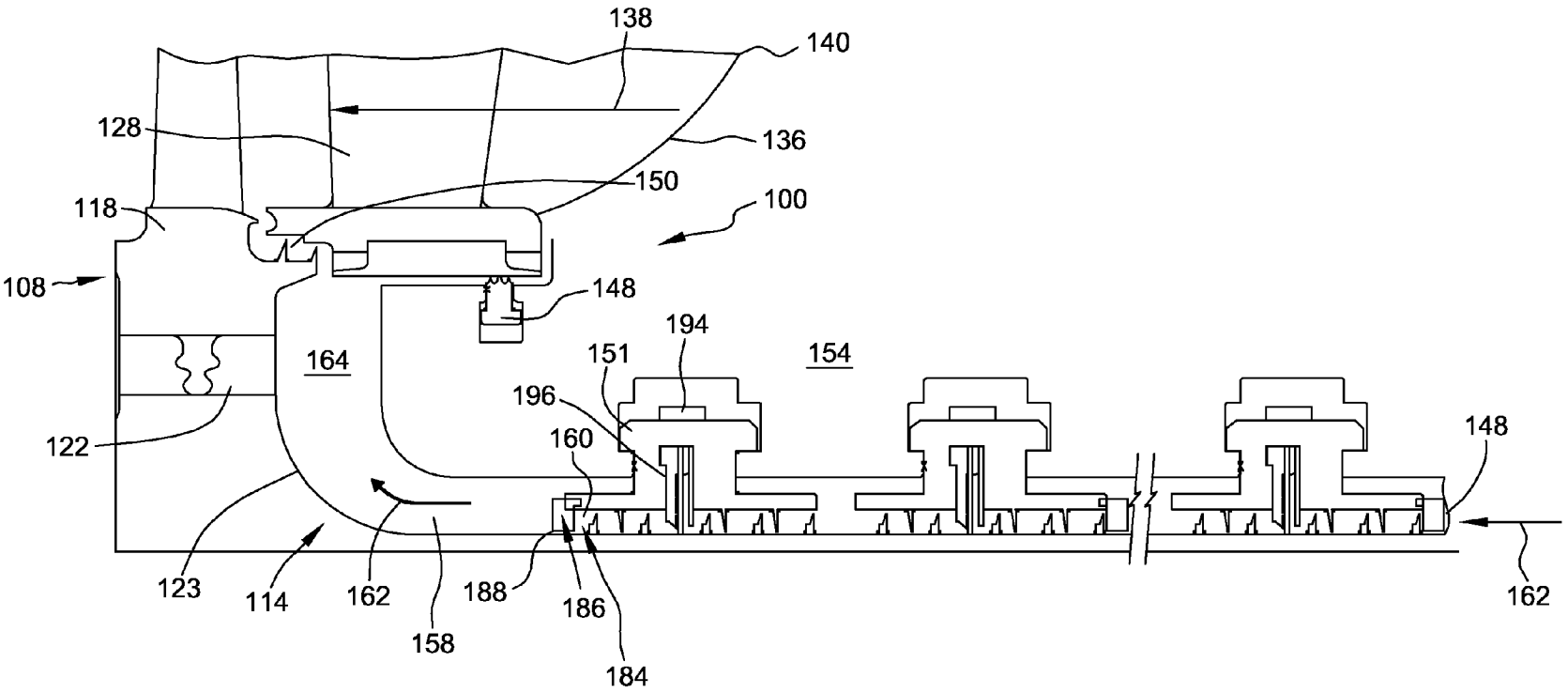
FIG. 5 is another side view of the steam turbine shown in FIG. 1 and the anti-swirl device coupled to the steam turbine.

FIG. 5 is another side elevational view of steam turbine 100 and anti-swirl device 186. In the exemplary embodiment, anti-swirl device 186 is coupled to second seal member 151. More particularly, anti-swirl device 186 is integrally coupled to second seal member 151. Alternatively, anti-swirl device 186 can be removable coupled to second seal member 151. Anti-swirl device 186 is coupled to a downstream side of second seal member 151 and upstream of rotor wheelspace 164 with respect to second steam flow 162 to facilitate reducing and/or eliminating and/or reversing steam swirl 184 present within second steam flow 162.

During operation, primary steam flow 138, at high pressures and high temperatures, is directed from steam source 140, through steam inlet 136 and towards primary flow path 130. More particularly, primary steam flow 138 is directed towards blades 118 and vanes 128. As primary steam flow 138 contacts blades 118, primary steam flow 138 rotates blades 118 and rotor 114. Primary steam flow 138 passes through stages 108 in a downstream direction and flows through successive stages (not shown) in a similar manner.

Steam flow that does not perform work by flowing through the plurality of blades 118 and rotating rotor 114 is considered a leakage flow. Leakage flow that does not perform work in a steam turbine 100 results in a loss output. First seal member 150 is configured to reduce leakage of primary steam flow 138 into wheelspace 164. Meanwhile, second steam flow 162, which is directed from cooling flow source 111, flows through second seal member 151 and anti-swirl device 186. More particularly, second steam flow 162 flows through vanes 188 of anti-swirl device 186.

During operation, second steam flow 162, at lower temperatures and higher pressures than primary steam flow 138 after vane 128, is directed through packing head 154. In the exemplary operation, second steam flow 162 is directed through cooling flow path 156. As second steam flow 162 travels through seal 151, and second flow path 156, second steam flow 162 gains a rotating speed from rotor 114 which generates swirl 184 within second steam flow 162. Second steam flow 162 continues to flow past second seal member 151 and in contact with anti-swirl device 186. Vanes 188 capture or channel second steam flow 162 and reduce tangential velocity of and/or reverse the direction of second steam flow 162. Therefore, the relative speed between rotor 114 and second steam flow 162 will approach the rotating speed of rotor 114, which increases the heat transfer between rotor 114 and second steam flow 162 in rotor wheelspace 164 to facilitate cooling rotor body 123.

Anti-swirl device 186 reduces and/or eliminates effects of steam swirl 184 present in second steam flow 162 to enhance heat transfer due to the higher relative rotational speed between rotor 114 and second steam flow 162. More particularly, the angle $\alpha$ of vane 188 is configured to alter the flow direction of second steam flow 162 to reduce positive steam swirl 184. Alternatively, vane 188 is sized and shaped to reverse steam swirl 184 present in second steam flow 162 by setting the angel $\alpha$ of vane 188 against rotor rotating direction to achieve a negative swirl (not shown). Second steam flow 162 passes anti-swirl device 186 and contacts rotor wheelspace 164 at high relative velocity to facilitate heat transfer from rotor 114 and into second steam flow 162. More particularly, during operation, second steam flow 162 is directed past anti-swirl device 186 and contacts at least one of rotor body 123, roots 122, blades 118, and rotor wheelspace 164 to facilitate heat transfer therefrom.

Moreover, during operation, spring 194 via arm 196 biases anti-swirl device 186 into first position 191 (shown in FIG. 2) with a small clearance with rotor 114. Second steam flow 162 proceeds through channels within vane 188 which redirects second steam flow 162 into axial and/or reversed rotating flow direction. Upon exiting vanes 188, second steam flow 162 facilitates cooling rotor wheelspace 164. If there are large rotor excursions during transient times, such as startup and shutdown, rotor 114 could contact second end 180. Should rotor 114 contact second end 180, rotor 114 moves anti-swirl device 186 against spring 194 and outward to second position 193 (shown in FIG. 3) so as to avoid hard-rub damage to rotor 114.

Figure 6:
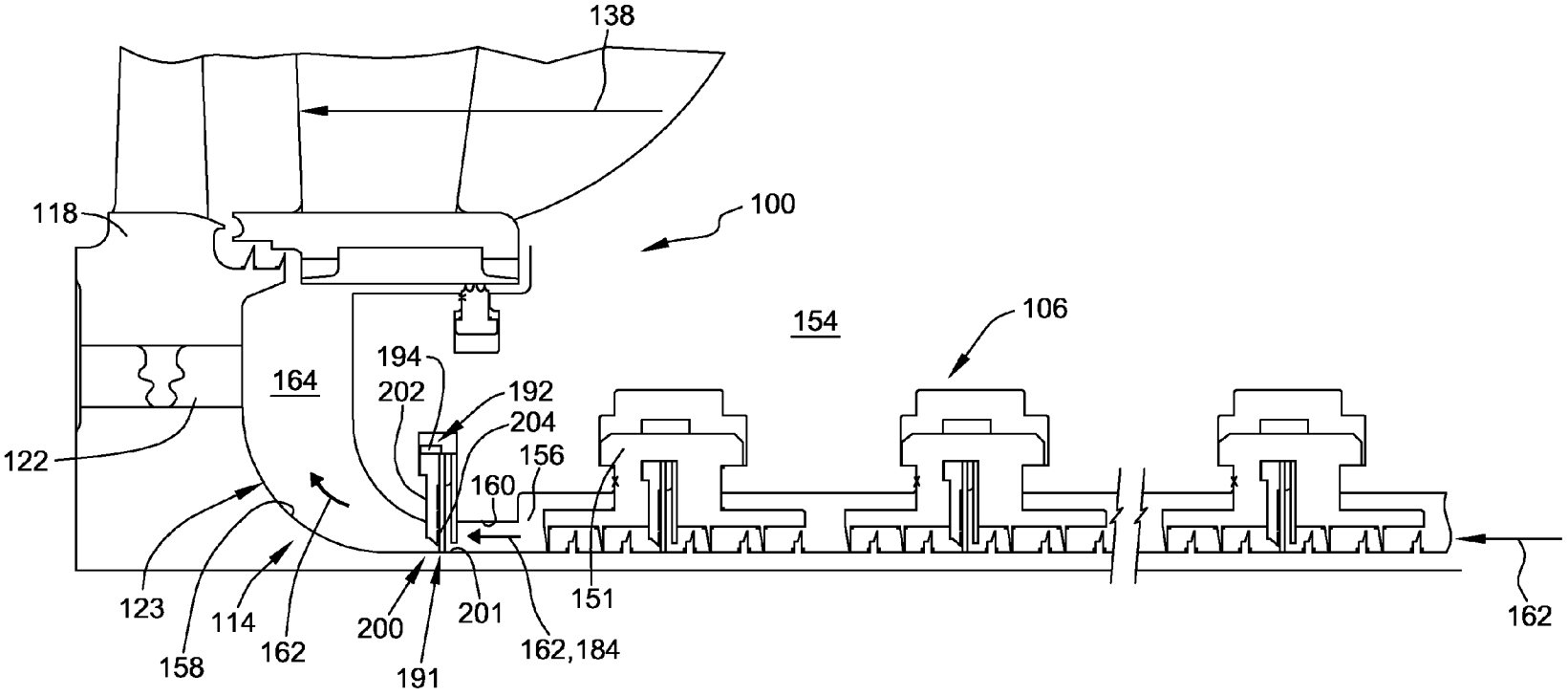
FIG. 6 is a side elevational view of the steam turbine shown in FIG. 1 and including an alternative anti-swirl device.

FIG. 6 is a side elevational view of steam turbine 100 and an alternative anti-swirl device 200 coupled to steam turbine 100. In FIG. 6, similar components of FIGS. 1-5 are labeled with the same element numbers. In the exemplary embodiment, anti-swirl device 200 is between seal 151 and wheelspace 164. Anti-swirl device 200 is coupled to packing head 154 and extends toward rotor 114. Anti-swirl device 200 includes a brush seal 202 that is located between first section 158 and second section 160 and spaced away from seal member 151. Brush seal 202 includes tightly-packed, generally cylindrical bristles 204 having porous media configured to filter out swirl 184 in the second steam flow 162. Brush seal 202 can be any porous media type of device that has high resistance to circumferential flow. In the exemplary embodiment, bristles 204 have a low radial stiffness that enables movement during turbine operation while maintaining a tight clearance during steady state operations. Spring loaded device 192 moves bristles 204 between first position 191 and second position 193 (shown in FIG. 2 and respectfully 3) within second section 160. In first position 191, a bristle end 201 is near rotor 114; and in second position 193, bristle end 201 is away from rotor 114.

During an operation, second steam flow 162, at lower temperatures than primary steam flow 138, is directed through end region 106 via packing head 154. In the exemplary operation, second steam flow 162 is directed through cooling flow path 156. As second steam flow 162 travels through the small gap between seal 151 and rotor 114, second steam flow 162 gains a rotating speed from rotor 114 which generates swirl 184 within second steam flow 162. More particularly, second steam flow 162 is directed through second section 160 and across seal 151. Second section 160 directs second steam flow 162 from seals 151 and toward anti-swirl device 200.

Anti-swirl device 200 reduces and/or eliminates effects of swirl 184 present in second steam flow 162 to facilitate increasing relative velocity of second steam flow 162 to rotor 114. Second steam flow 162 passes anti-swirl device 200 and contacts rotor 114 to facilitate heat transfer from rotor 114 into second steam flow 162. More particularly, during operation, second steam flow 162 is directed past anti-swirl device 200 and contacts at least one of rotor body 123, roots 122, blades 118 and wheelspace 164 to facilitate heat transfer therefrom. Second steam flow 162 continues to flow and mixes with primary steam flow 138.

Alternatively, anti-swirl device 200 may include hydrodynamic face seals (not shown) to facilitate reducing leakage of a pressurized fluid through packing head 154. Hydrodynamic face seals include a mating (rotating) ring (not shown) and a seal (stationary) ring (not shown). Generally, shallow hydrodynamic grooves (not shown) are formed or etched on mating ring face. During operation, hydrodynamic grooves in the rotating ring generate a hydrodynamic force that causes stationary ring to lift or separate from the rotating ring such that a small gap is created between the two rings. A sealing gas flows via the gap between the rotating and stationary rings.

Figure 7:
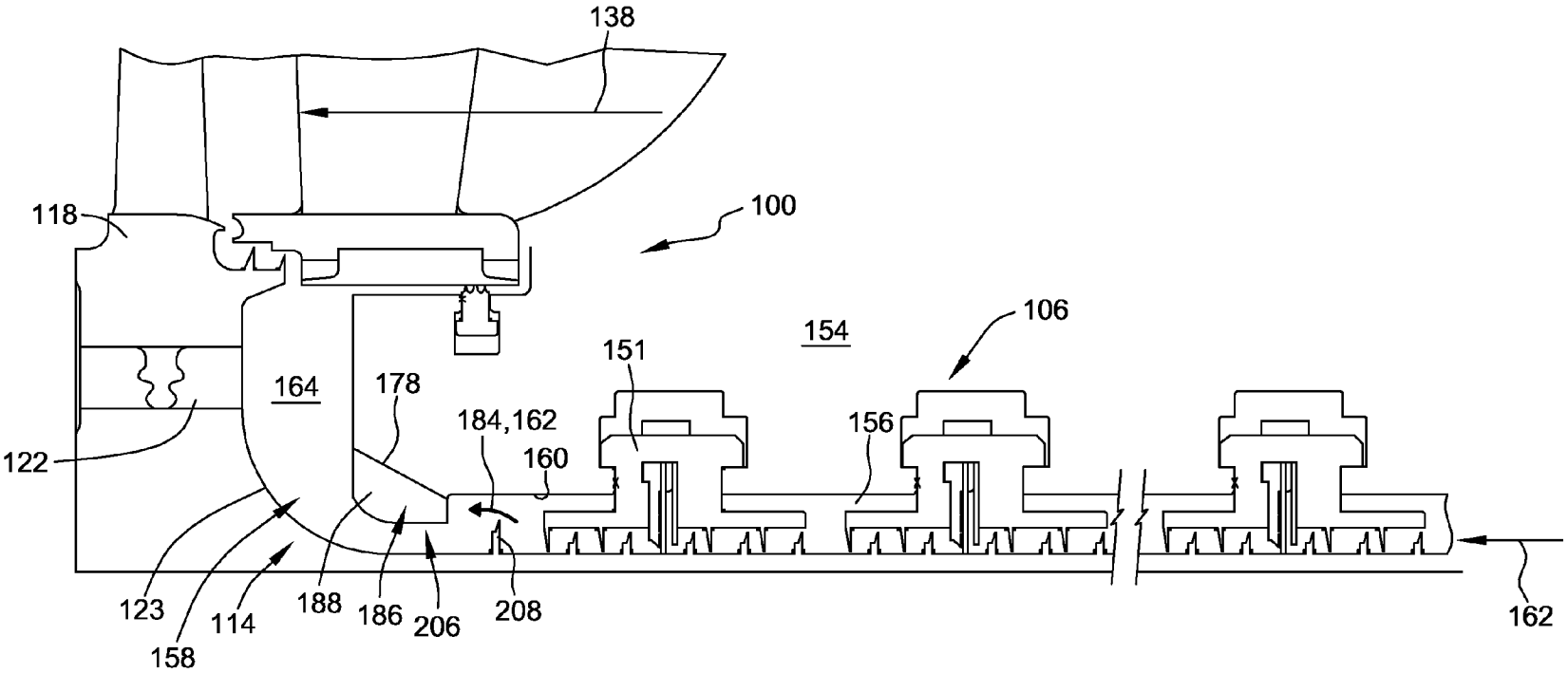
FIG. 7 is a side view of the steam turbine shown in FIG. 1 and including yet another alternative anti-swirl device.

FIG. 7 is a side elevational view of steam turbine 100 and an alternative anti-swirl device 206 coupled to steam turbine 100. In the exemplary embodiment, anti-swirl device 206 is integrally formed with packing head 154. Anti-swirl device 206 includes a flow deflector 208 within second section 160 and spaced away from seal member 151. Flow deflector 208 directs second steam flow 162 that is flowing through cooling flow path 156, and in particular, flowing through second section 160, into the anti-swirl device 206. Anti-swirl device 206 is configured to reduce and/or eliminate swirl 184 present within second flow path 162. Alternatively, anti-swirl device 206 reverses steam swirl 184 present within second steam flow 162 to increase relative velocity to enhance heat exchange from rotor 114 and into second steam flow 162.

Anti-swirl device 206 reduces and/or eliminates effects of swirl 184 present in second steam flow 162 to facilitate increasing relative velocity of second steam flow 162 to rotor 114. Second steam flow 162 passes anti-swirl device 206 and contacts rotor 114 to facilitate heat transfer from rotor 114 into second steam flow 162. More particularly, during operation, second steam flow 162 is directed past anti-swirl device 206 and contacts at least one of rotor body 123, roots 122, blades 118 and wheelspace 164 to facilitate heat transfer therefrom. Second steam flow 162 continues to flow and mixes with primary steam flow 138.

Figure 8:
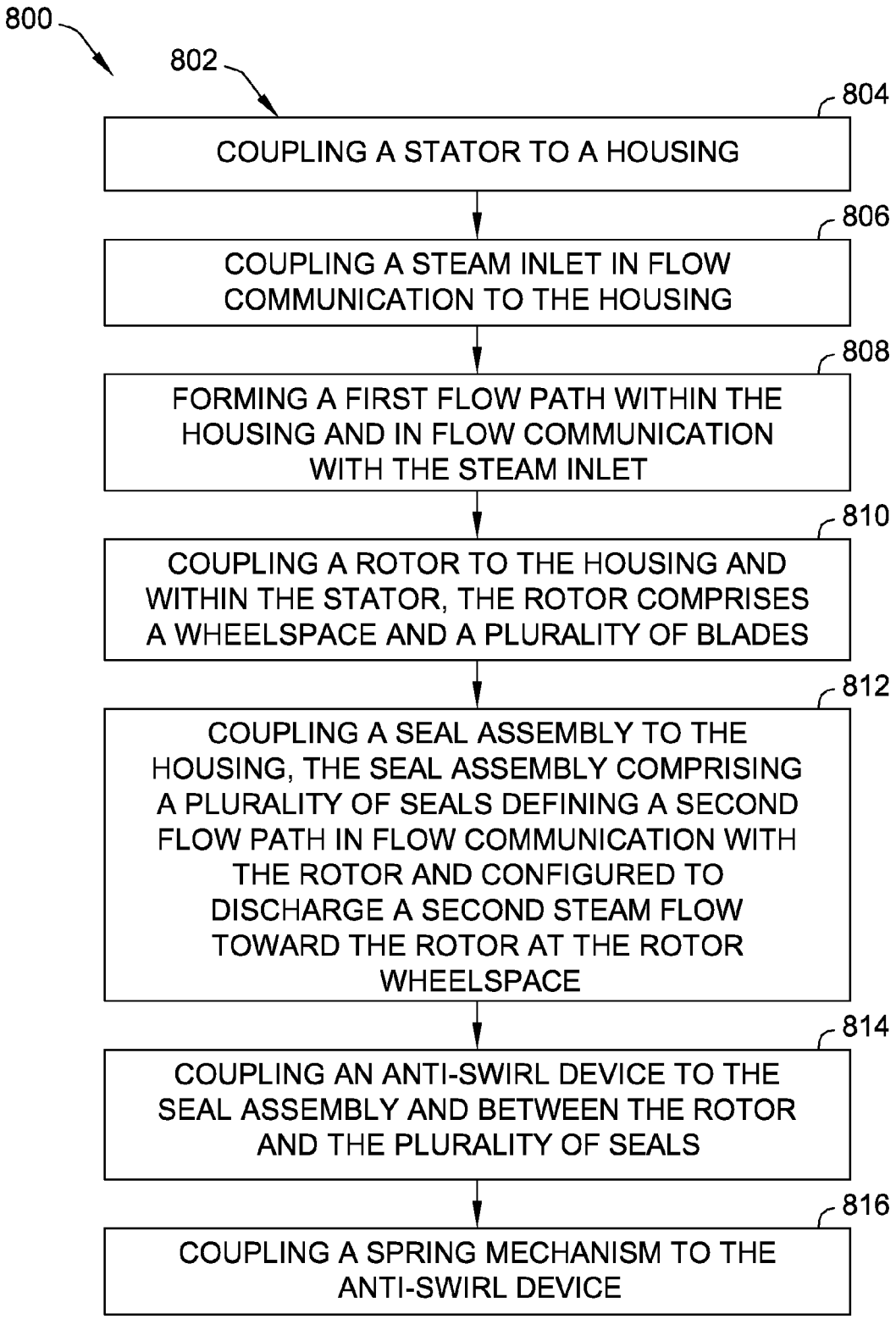
FIG. 8 is a flowchart illustrating an exemplary method of manufacturing a steam turbine.

FIG. 8 is an exemplary flowchart 800 illustrating a method 802 of manufacturing a steam turbine, for example steam turbine 100 (shown in FIG. 1). Method 802 includes coupling 804 a stator, for example stator 126 (shown in FIG. 1) to a housing, such as housing 124 (shown in FIG. 1). A steam inlet, for example steam inlet 136 (shown in FIG. 1), is coupled 806 in flow communication to the housing. Method 802 also includes forming 808 a first flow path, such as first flow path 130 (shown in FIG. 1), within the housing and in flow communication with the steam inlet. Method 802 further includes coupling 810 a rotor, such as rotor 114 (show in FIG. 1), to the housing and within the stator, wherein the rotor comprises a plurality of blades, for example blades 118 (shown in FIG. 1), and a wheelspace such as, for example wheelspace 164 (shown in FIG. 1).

In the exemplary method 802, a seal assembly, for example seal assembly (shown in FIG. 1), is coupled 812 to the housing. The seal assembly includes a plurality of seals, such as seal member 151 (shown in FIG. 2), defining a second flow path, such as second flow path 156 (shown in FIG. 2), in flow communication with the rotor and configured to discharge a second steam flow, for example second steam flow 162 (shown in FIG. 2) toward the rotor at a rotor wheelspace. Method 802 includes coupling 814 an anti-swirl device, for example anti-swirl device 186 (shown in FIG. 1), to the seal assembly and between the rotor wheelspace and the seals. Coupling 814 the anti-swirl device includes coupling a vane, for example vane 188 (shown in FIG. 2), within the cooling flow path and downstream of the seals 151. Method 802 further includes coupling 816 a spring loaded device, such as spring loaded device 192 (shown in FIG. 2), to the anti-swirl device.

A technical effect of the systems and methods described herein includes at least one of: (a) coupling an anti-swirl device to an exit side of a packing head; (b) reducing and/or reversing a steam swirl present in cooling steam to enhance heat transfer from the steam turbine; (c) enhancing a cooling effect on a rotor of a steam turbine; (d) reducing manufacturing, operating, and/or maintenance costs of a turbine component; and (e) increasing an operating life of a steam turbine.

The exemplary embodiments described herein facilitate heat transfer from a rotor of a steam turbine. The embodiments described use an anti-swirl device coupled to an exit side of a packing head to reduce and/or to reverse steam swirl of cooling steam as the cooling steam exits the packing head and flows toward the rotor. The anti-swirl device alters the steam swirl to enhance the heat transfer from the steam turbine, and in particular, the rotor. By enhancing cooling of the rotor, the embodiments described herein reduce operating and/or maintenance costs. Moreover, the embodiments described herein increase the operating life of the steam turbine.

Exemplary embodiments of a steam turbine and methods for assembling the steam turbine are described above in detail. The methods and systems are not limited to the specific embodiments described herein, but rather, components of systems and/or steps of the methods may be utilized independently and separately from other components and/or steps described herein. For example, the methods may also be used in combination with other manufacturing systems and methods, and are not limited to practice with only the systems and methods as described herein. Rather, the exemplary embodiment can be implemented and utilized in connection with many other thermal applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine comprising:

a housing comprising an inlet configured to discharge a primary steam flow into said housing;

a stator coupled to said housing;

a rotor coupled to said housing and located within said stator, said rotor and said stator define a primary flow path there between, said primary flow path is in flow communication with the primary steam flow, said rotor comprising a rotor wheelspace;

a seal assembly coupled to said housing, said seal assembly comprising a packing head and a plurality of seals, said packing head defines a cooling flow path that is in flow communication with said rotor at said rotor wheelspace, said cooling flow path is configured to discharge a cooling steam flow towards said rotor wheelspace; and an anti-swirl device coupled to said seal assembly between said rotor wheelspace and said packing head.

2. The steam turbine of claim 1, wherein said anti-swirl device is located within said cooling flow path.

3. The steam turbine of claim 1, wherein said plurality of seals comprises an upstream seal and a downstream seal with respect to said cooling steam flow and said anti-swirl device is coupled to said downstream seal.

4. The steam turbine of claim 3, wherein said anti-swirl device comprises a vane coupled to said downstream seal.

5. The steam turbine of claim 1, wherein said plurality of seals comprises an upstream seal and a downstream seal with respect to the cooling steam flow and said anti-swirl device is located within said cooling flow path and between said rotor wheelspace and said downstream seal.

6. The steam turbine of claim 1, wherein said anti-swirl device comprises a vane and a spring-loaded device coupled to said vane, said spring-loaded device configured to move said vane between a first position and a second position within said cooling flow path.

7. The steam turbine of claim 1, wherein said anti-swirl device comprises a flow deflector.

8. The steam turbine of claim 1, wherein said anti-swirl device comprises a spring-loaded brush.

9. The steam turbine of claim 1, wherein said anti-swirl device is configured to reduce a swirl of the cooling steam flow.

10. The steam turbine of claim 1, wherein said anti-swirl device is configured to reduce a velocity of the cooling steam flow.

11. A rotor assembly coupled to a housing and located within a primary flow path, said rotor assembly comprising:

a rotor coupled to the housing and comprising a rotor wheelspace;

a seal assembly coupled to said housing, said seal assembly comprising a plurality of seals that define a cooling flow path that is in flow communication with said rotor wheelspace and discharges a cooling steam flow toward said rotor wheelspace; and an anti-swirl device coupled to said seal assembly downstream from said plurality of seals and between said rotor wheelspace and said plurality of seals, said anti-swirl device is configured to reduce a swirl of said cooling steam flow.

12. The rotor assembly of claim 11, wherein said anti-swirl device is located within said cooling flow path.

13. The rotor assembly of claim 11, wherein said plurality of seals comprises an upstream seal and a downstream seal with respect to the cooling steam flow and said anti-swirl device is coupled to said downstream seal.

14. The rotor assembly of claim 11, wherein said plurality of seals comprises an upstream seal and a downstream seal with respect to the cooling steam flow and said anti-swirl device is located within said cooling flow path and between said rotor wheelspace and said downstream seal.

15. The rotor assembly of claim 11, wherein said anti-swirl device comprises a flow deflector.

16. The rotor assembly of claim 11, wherein said cooling flow path is configured to discharge the cooling steam flow at a predetermined pressure toward said rotor wheelspace.

17. A method of assembling a steam turbine, said method comprising:

coupling a stator to a housing;

coupling a steam inlet in flow communication to the housing;

forming a first flow path within the housing and in flow communication with the steam inlet;

coupling a rotor to the housing and within the stator, the rotor comprises a rotor wheelspace and a plurality of blades;

coupling a seal assembly to the housing, the seal assembly comprising a plurality of seals that define a second flow path in flow communication with the rotor and discharges a second steam flow toward the rotor at the rotor wheelspace; and coupling an anti-swirl device to the seal assembly downstream from the plurality of seals and between the rotor wheelspace and the plurality of seals.

18. The method of claim 17, wherein coupling the anti-swirl device comprises coupling a vane to a downstream seal of the plurality of seals.

19. The method of claim 17, wherein coupling the anti-swirl device comprises coupling a vane to the seal assembly and within the cooling flow path.

20. The method of claim 17, further comprising coupling a spring mechanism to the anti-swirl device.

* * * * *